United States Patent [19]

Hulsing

[11] 4,195,783

[45] Apr. 1, 1980

[54] PLUNGER VALVE NOZZLE

[76] Inventor: Kenneth L. Hulsing, 12619 Beacon Hill Ct., Plymouth, Mich. 48170

[21] Appl. No.: 866,595

[22] Filed: Jan. 3, 1978

[51] Int. Cl.[2] ..... B05B 1/32; F02M 47/00

[52] U.S. Cl. ..... 239/533.3; 239/563

[58] Field of Search ..... 239/533.3, 533.4, 533.5, 239/533.6, 533.7, 533.8, 533.9, 533.11, 533.12, 453, 563

[56] References Cited

U.S. PATENT DOCUMENTS

| | | | |
|---|---|---|---|
| 1,898,325 | 2/1933 | Venn | 239/453 |
| 2,035,203 | 3/1936 | Smith | 239/533.12 |
| 3,982,693 | 9/1976 | Hulsing | 239/533.3 |

*Primary Examiner*—John J. Love

*Assistant Examiner*—Michael J. Forman

*Attorney, Agent, or Firm*—Reising, Ethington, Barnard, Perry & Brooks

[57] ABSTRACT

A plunger valve nozzle has a nozzle body with a constant diameter bore extending therethrough, one end of which is open to receive fluid under pressure and has a hollow plunger extending thereinto with a direct acting piston portion slidably fitting the bore and exposed to the fluid pressure through the open end of the bore, there being orifices connecting the interior of the plunger to the periphery of the piston portion which are uncovered by the bore when the fluid pressure is sufficient to move the plunger further inwardly of the bore a predetermined distance, which movement is opposed by a spring connected to the plunger and reacting against the nozzle body.

3 Claims, 5 Drawing Figures

PLUNGER VALVE NOZZLE

TECHNICAL FIELD

This invention relates to nozzles of the plunger valve controlled type for injecting liquid under pressure, such as liquid fuel into an engine combustion chamber, and particularly to such a plunger valve nozzle for small engines.

BACKGROUND ART

In my prior U.S. Pat. No. 3,982,693 I disclosed a plunger valve nozzle in a fuel injector of the unit type, i.e. having both the pump and nozzle combined in a single assembly. In that prior design the fuel pressure delivered by the pump was conducted through a series of drilled passages in the side walls of the spring chamber and connecting passages in the nozzle body to a stepped bore for the plunger where it applied against differential areas on the piston portion of the plunger to effect the necessary orifice opening movement required for injection. Such differential pressure areas on the plunger combined with the necessary stepped bore therefor in the nozzle body served to reduce the fuel pressure force on the plunger in the orifice opening direction, enabling the use of a lower rate, and thus smaller plunger return spring which could be housed in the envelope.

Other plunger valve nozzles of quite different type are disclosed in U.S. Pat. No. 2,762,654 to Purchas, Jr. et al and No. 2,035,203 to Smith.

DISCLOSURE OF THE INVENTION

My present invention provides a plunger valve nozzle of unique design which adapts it for use in small engines and realizes important savings in cost of manufacture.

Whereas it has always been a problem in larger size engine applications to obtain sufficient spring load to adequately bias return movement of the plunger valve at the end of injection, I have found that for a small engine the plunger valve may be made small enough to be of the direct acting piston type. This not only avoids the necessity of having to provide a stepped arrangement of two different diameter bores in the nozzle, with attendant differential pressure areas on the piston portion of the plunger, but also allows the use of a much simpler passage means for conducting the fuel supply pressure to the plunger valve. No separate drilled passages in the walls of the spring chamber with connecting drilled passages in the nozzle body are thus required, and instead the supply is connected directly to the spring chamber which is open to the nozzle bore and to the plunger internal passage leading to the spray orifices.

It is accordingly the principal object of my invention to provide a relatively low cost plunger valve nozzle suitable for small engine fuel injection requirements.

The best mode for carrying out the invention will now be described with reference to the accompanying drawings.

BEST MODE FOR CARRYING OUT THE INVENTION

Figure 1:
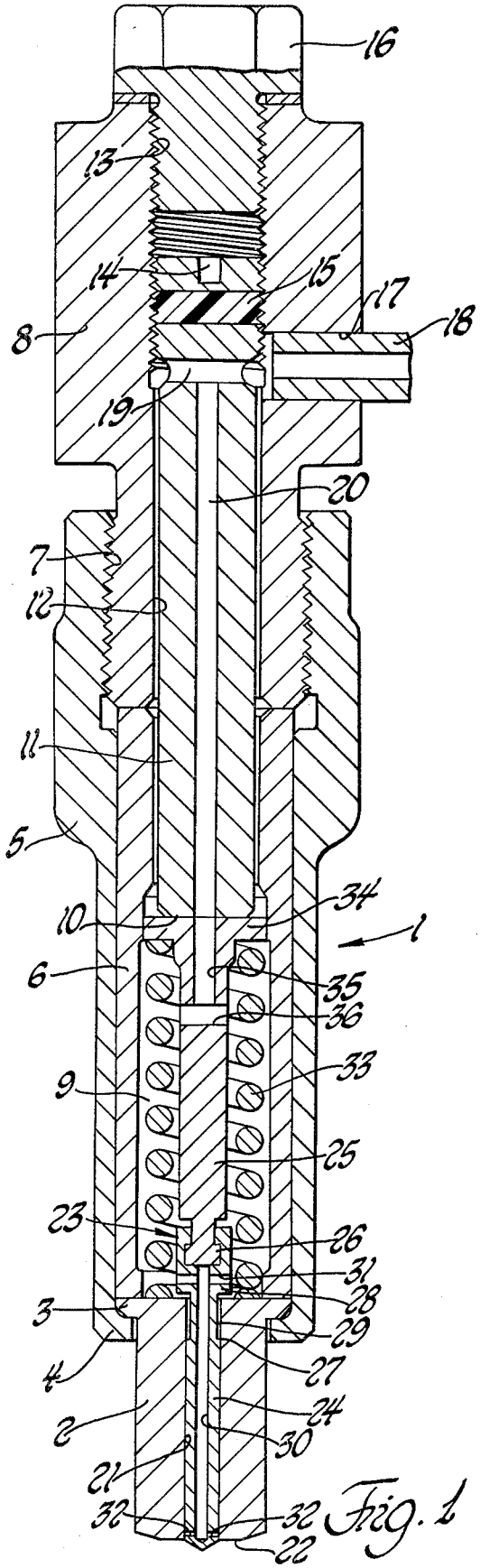
FIG. 1 is a longitudinal sectional view of a plunger valve nozzle embodying the invention.

Referring to FIG. 1, a plunger valve nozzle is designated generally by the numeral 1 and includes a nozzle body 2 at its lower end which is adapted to extend into an engine combustion chamber (not shown) for the injection of liquid fuel. Supporting means associated with the nozzle body 2 include an external flange 3 at its upper end which is clamped between an underlying internal flange 4 of a nut 5 and the lower end of a sleeve-shaped spacer member 6. The upper end of the nut is provided with internal threads 7, and retained therein is the externally threaded lower end of an upper body member 8 which abuts the upper end of the spacer member 6 and holds it clamped against the nozzle body flange 3. The spacer member 6 defines a spring chamber 9 extending between the nozzle body 2 and the lower end 10 of a screw 11. This screw extends through the upper end of the spacer member and into a longitudinal passage 12 which extends through the upper body member 8. The upper portion of this passage 12 is provided with internal threads 13 engaging the externally threaded upper portion of the screw 11. A screw driver slot 14 is shown provided in the upper end of the screw for effecting its rotation in making desired adjustments of the height of its lower end 10, and suitable means such as the plastic insert 15 may be employed for locking the screw in its various adjusted positions. Removable closure means for the upper end of the passage 12 is shown in the form of a simple cap screw 16.

Passage means for conducting liquid fuel under pressure to the spring chamber 9 from a pump (not shown) is provided in the supporting means for the nozzle body and includes a lateral opening 17 in the upper body member 8 for reception of a fuel delivery pipe 18, which opening 17 connects with the longitudinal passage 12, and an internal passage in the screw 11 which comprises a drilled cross hole 19 and a connecting longitudinally drilled hole 20 extending from the cross hole 19 to the lower end 10 of the screw 11.

The nozzle body 2 has a bore 21 of constant diameter extending therethrough which is open at its upper end to the spring chamber 9. At its lower end this bore is defined by and preferably makes a sharp juncture with the transversely extending bottom end face 22 of the nozzle body. Extending into the bore 21 from the spring chamber is a plunger, designated generally by the numeral 23 and shown as having a lower part 24 and upper part 25 joined together in end-to-end relation by a conventional horseshoe type joint 26 so as to operate as a unit. The lower part 24 of the plunger includes a direct acting piston portion 27 which has a close sliding fit in the bore 21, an enlarged portion 28 which overlies the nozzle body opposite the open upper end of the bore, and an intermediate portion 29 of reduced section relative to the cross sectional area of the bore. An internal passage 30 extends longitudinally of the lower part 24 of the plunger which is in open communication at its upper end with the spring chamber, as by an intersecting cross hole 31 drilled through the enlarged portion, and is connected to the outer periphery of the piston portion 28 near the lower end thereof by a plurality of small transversely drilled spray orifices 32. Completing the assembly is spring means shown in the form of a coil compression spring 33 encircling the plunger within the spring chamber. The upper end of this spring is retained by the flanged upper end 34 of the plunger part 25 and reacts at its lower end against the nozzle body 2. In the normal retracted position of the plunger 23 illustrated in FIG. 1 its flanged upper end 34 is held in abutment with the lower end 10 of the screw 11, and to ensure open fluid communication of the spring chamber with the drilled hole 20 in this screw the upper end of plunger part 25 may be provided with an axially drilled hole 35 and intersecting cross hole 36.

In operation, upon the fuel supply pressure in the delivery pipe 18 increasing to a pre-selected level, such as in the order of 10,000 pounds per square inch, this pressure will be transmitted to the spring chamber via the internal passage 19, 20 in the screw. Also, since the upper end of the bore 21 in the nozzle body is open to the spring chamber, the reduced section 29 of the plunger portion 29 will expose the direct acting piston portion 27 of the plunger to this increased fuel pressure in the spring chamber, forcing the plunger to move downwardly in opposition to the spring 33. Such downward movement of the plunger continues until the enlarged portion 28 acts as a stop therefor by moving into abutment with the nozzle body 2. Sufficient clearance, however, is provided between the plunger portion 28 and the nozzle body that the spray orifices 32, which are normally closed by the bore 21, will be uncovered by the nozzle body end face 22, allowing fuel to flow from the spring chamber via the plunger internal passage 30 and be injected into the combustion chamber of the engine through these orifices 32. Thereafter, upon the fuel pressure in the delivery pipe being relieved, the fuel pressure in the spring chamber and the upper end of the nozzle body bore 21 will likewise fall, and the spring 33 will effect return of the plunger to its normally retracted position shown in FIG. 1 in which the flanged upper end 34 is in abutment with the lower end 10 of the screw 11 and the spray orifices 34 are again closed by the bore 21. The screw 11 thus serves as stop means limiting the return movement of the plunger, and, since this screw is adjustably rotatable in the upper body member 8, the axial position of the plunger relative to the nozzle body 2 may be preselected for different fuel injection pressures in tuning the plunger valve nozzle for best operation with its associated engine combustion chamber.

Figure 2:
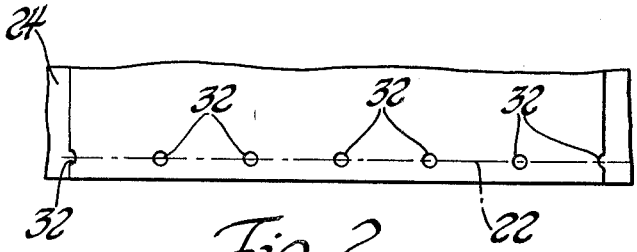
FIGS. 2–5 are fragmentary sectional views, developed 360 degrees, to diagrammatically illustrate four respectively different arrangements of multiple spray orifices with which the lower end of the plunger valve in FIG. 1 may be provided.
Figure 3:
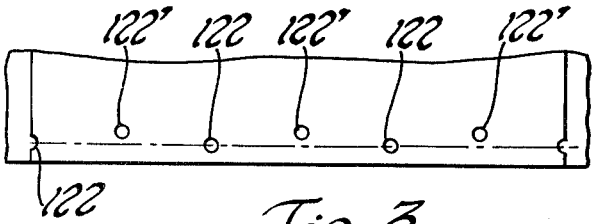
Figure 4:
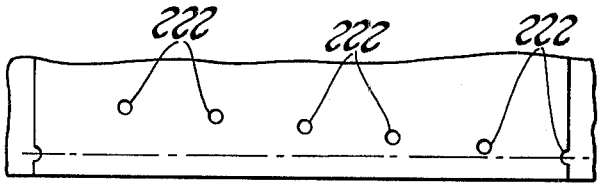
Figure 5:
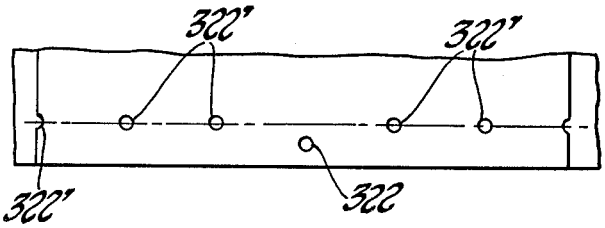

FIG. 2 illustrates, by a diagrammatic 360 degree development of the lower end of the plunger part 24, the use of six spray orifices 32 located for simultaneous opening and closing by the nozzle body end face 22. FIG. 3 similarly illustrates an arrangement wherein three of the spray orifices 122 are simultaneously opened earlier and closed later than the remaining three orifices 122'. In FIG. 4 the six spray orifices 222 are shown arranged for sequential opening and closing, and in FIG. 5 one orifice 322 is positioned to be opened in advance of the simultaneous opening of the other five orifices 322', thereby obtaining a pilot injection of reduced quantity of fuel prior to the main injection charge. The direct acting piston feature of my plunger valve nozzle, as previously described with reference to FIG. 1, enables use of any of these spray orifice arrangements within the range of adjustment obtainable by the screw 11.

Having shown and described what is believed the best mode for carrying out my invention, it will be understood that various minor changes in the parts and their arrangement may be made without departing from the scope of the invention as hereinafter claimed.

What is claimed is:

1. In a fuel injection nozzle of the plunger valve type, a nozzle body having a constant diameter bore extending therethrough, a plunger having an upper part and a lower part connected together, said lower part having a piston portion slidably fitting said bore, an enlarged portion abuttable with the nozzle body at one end of the bore to limit movement of the plunger in the direction toward the opposite end of the bore and an intermediate portion of reduced section extending into said one end of the bore from said enlarged portion, means for conducting fuel under pressure to said one end of the bore for operation against the piston portion to effect movement of the plunger in said direction, spring means connected to said plunger upper part and reacting against the nozzle body to resiliently oppose said movement of the plunger by the fuel pressure, said spring means being yieldable to accommodate said movement of the plunger and operable to effect return movement of the plunger in the opposite direction when said fuel pressure is relieved, stop means connected to the nozzle body and abuttable by said plunger upper part to limit return movement of the plunger by the spring means, said piston portion having an internal passage extending longitudinally thereof and open at one end to the fuel pressure in said one end of the bore, the opposite end of said internal passage having a connecting orifice extending transversely to the periphery of the piston portion, said orifice being closed by the bore when said plunger upper part is in abutment with the stop means but being located sufficiently distant from said intermediate portion of the plunger to be uncovered by the nozzle bore when said enlarged portion is in abutment with the nozzle body at said one end of the bore.

2. In the fuel injection nozzle of claim 1, supporting means for said nozzle body including an external flange thereon, a hollow nut having an internal flange underlying said nozzle body flange, an elongated upper body having one end threadedly received in said nut, said upper body having a longitudinal passage extending therethrough, said longitudinal passage having internal threads at its end remote from the nut, a sleeve-shaped spacer member clamped end-wise between said nozzle body flange and the upper body within the nut, and an adjusting screw threadedly engaging said internal threads in the upper body and extending into said sleeve-shaped member to define said stop means for the plunger.

3. In the fuel injection nozzle of claim 2, wherein said upper body has a lateral opening extending therethrough to said longitudinal passage, and said adjusting screw is provided with an internal passage interconnecting said lateral opening and the interior of said spacer member, said lateral opening, screw passage and the interior of the spacer member defining said fuel conducting means.

* * * * *